US008154471B2

(12) United States Patent
Lo et al.

(10) Patent No.: US 8,154,471 B2
(45) Date of Patent: Apr. 10, 2012

(54) ANTENNA MODULE

(75) Inventors: Wen-Kuei Lo, Taipei (TW); Chai-Shun Huang, Taipei (TW)

(73) Assignee: Wistron NeWeb Corp., Hsinchu (TW)

( * ) Notice: Subject to any disclaimer, the term of this patent is extended or adjusted under 35 U.S.C. 154(b) by 545 days.

(21) Appl. No.: 12/336,456

(22) Filed: Dec. 16, 2008

(65) Prior Publication Data

US 2009/0256775 A1 Oct. 15, 2009

(30) Foreign Application Priority Data

Apr. 15, 2008 (TW) ..... 97113578 A

(51) Int. Cl.
*H01Q 1/50* (2006.01)

(52) U.S. Cl. ..... 343/906; 343/901; 343/702; 343/872

(58) Field of Classification Search ..... 343/713, 343/901, 906, 702, 872, 873, 715
See application file for complete search history.

(56) References Cited

U.S. PATENT DOCUMENTS

| | | | | |
|---|---|---|---|---|
| 6,486,843 | B2 * | 11/2002 | Wang et al. | 343/715 |
| 2006/0284771 | A1 * | 12/2006 | Liang et al. | 343/702 |
| 2008/0055184 | A1 * | 3/2008 | Noro et al. | 343/872 |

FOREIGN PATENT DOCUMENTS

| | | |
|---|---|---|
| TW | M294106 | 7/2006 |

* cited by examiner

*Primary Examiner* — Dieu H Duong

(57) ABSTRACT

An antenna module is disclosed, including a housing, an antenna disposed through the housing, a first member fixed to the housing, and a fastener. The housing comprises a flexible cantilever having a nub engaged in a through hole of the antenna. The fastener is disposed through first member and fixed to the antenna.

14 Claims, 7 Drawing Sheets

ANTENNA MODULE

CROSS REFERENCE TO RELATED APPLICATIONS

This Application claims priority of Taiwan Patent Application No. 97113578, filed on Apr. 15, 2008, the entirety of which is incorporated by reference herein.

BACKGROUND OF THE INVENTION

1. Field of the Invention

The invention relates in general to an antenna module and in particular to an antenna module preventing disengagement of the antenna from the housing.

2. Description of the Related Art

Referring to FIG. 1, a conventional antenna module primarily includes a telescopic antenna 10, a plastic housing 20, a metal nut 30 welded on the housing 20, and a cable 40. During assembly, the antenna 10 is inserted through the housing 20 along a C axis. A fastener S1, such as a metal screw, is subsequently fastened through the nut 30 and joined to the antenna 10, such that the antenna 10 and the nut 30 are electrically connected. Furthermore, a signal terminal (not shown) of the cable 40 is welded on an inner surface of the nut 30 to electrically connect the antenna 10.

Since the antenna 10 is fixed to the nut 30 by the fastener S1 but not directly fixed to the housing 20, the antenna 10 may disengage from the housing 20 and rotate around the C axis during usage (as the arrow indicates in FIG. 1), thus adversely decreasing communication stability and operating usage of the antenna module.

BRIEF SUMMARY OF INVENTION

The invention provides an antenna module including a housing, an antenna disposed through the housing, a first member fixed to the housing, and a fastener. The housing comprises a flexible cantilever having a nub engaged in a through hole of the antenna. The fastener is disposed through first member and joined to the antenna.

BRIEF DESCRIPTION OF DRAWINGS

The invention can be more fully understood by reading the subsequent detailed description and examples with references made to the accompanying drawings, wherein.

DETAILED DESCRIPTION OF INVENTION

Figure 2:
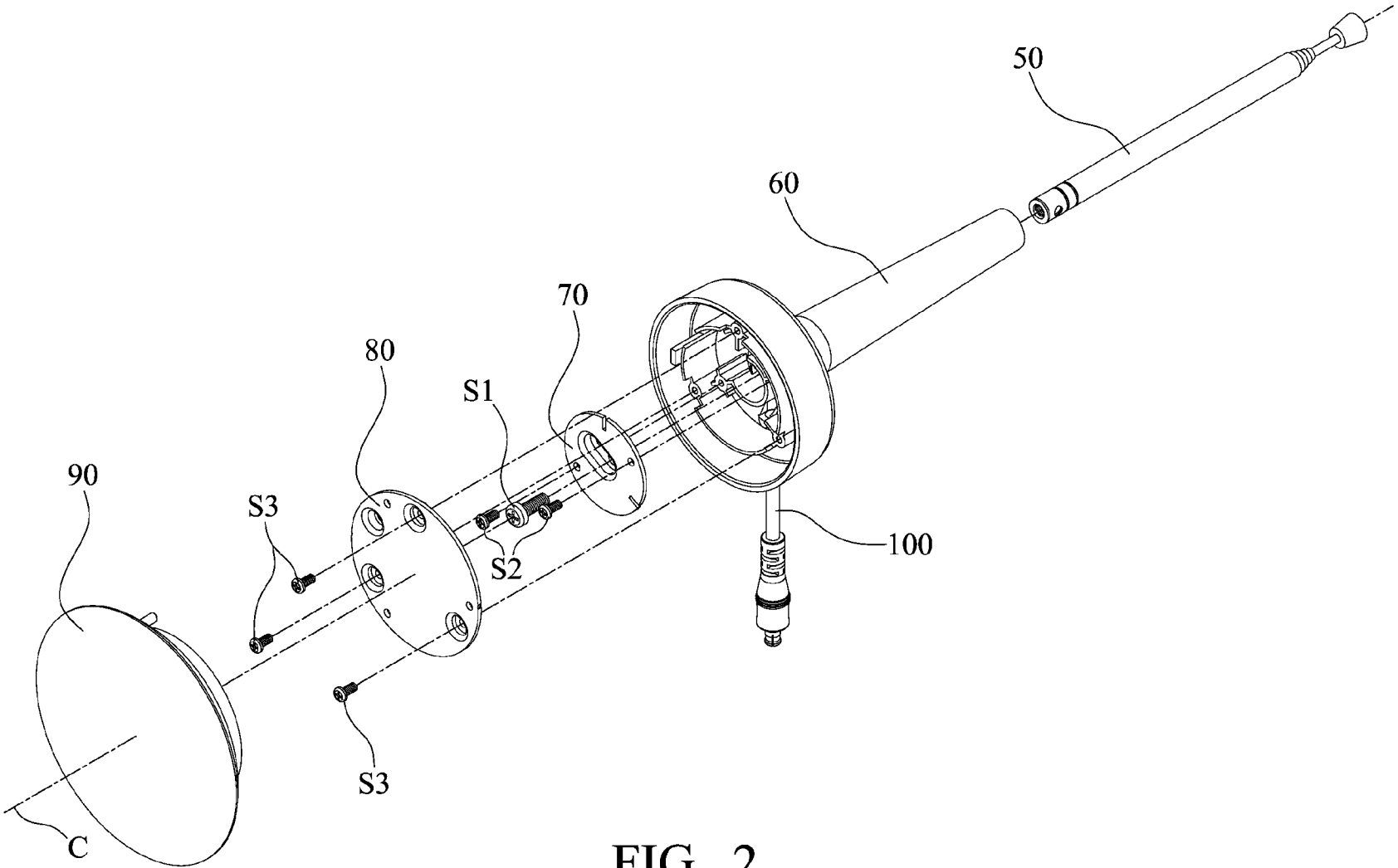
FIG. 2 is an exploded diagram of an antenna module according to an embodiment of the invention.

Referring to FIG. 2, an embodiment of an antenna module primarily comprises a telescopic antenna 50, a housing 60, a first member 70, a second member 80, a cover 90, and a coaxial cable 100. The antenna 10 is disposed through the housing 60 along a C axis. A metal fastener S1, such as a screw, is fastened through the first member 70 and joined to the antenna 10 along the C axis. In this embodiment, the first and second members 70 and 80 are fixed to the housing 60 by the screws S2 and S3, respectively, and the cover 90 is mounted on the housing 60 to protect the components therein.

Figure 3:
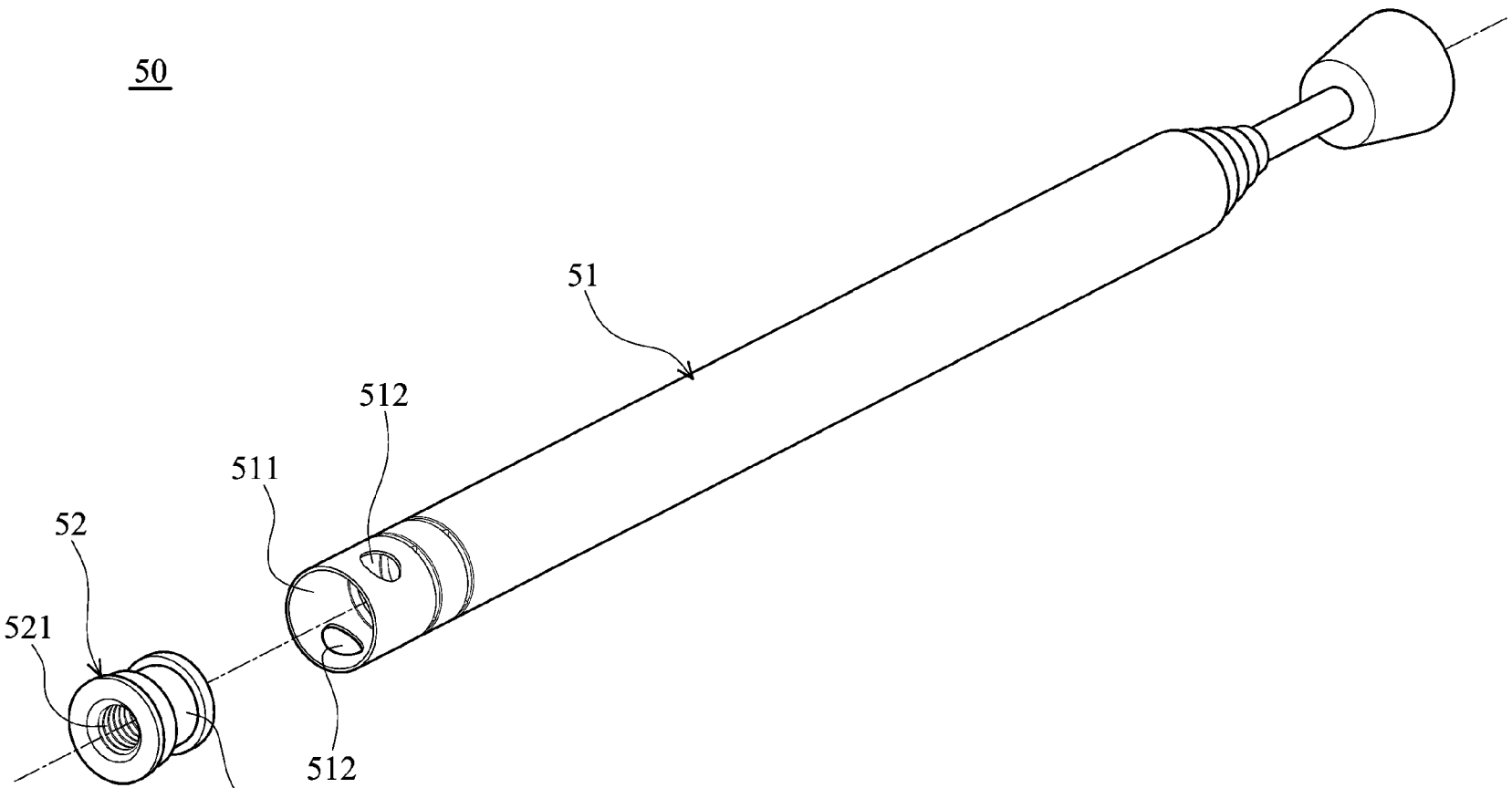
FIG. 3 is an exploded diagram of the antenna in FIG. 2.

Referring to FIG. 3, the antenna 50 primarily comprises a hollow main body 51 and a connecting member 52 fixed to an opening 511 of the main body 51. The connecting member 52 forms a threaded hole 521 and an annular recess 522 around the hole 521. Specifically, the main body 51 has two through holes 512 communicating with the annular recess 522.

Figure 4A:
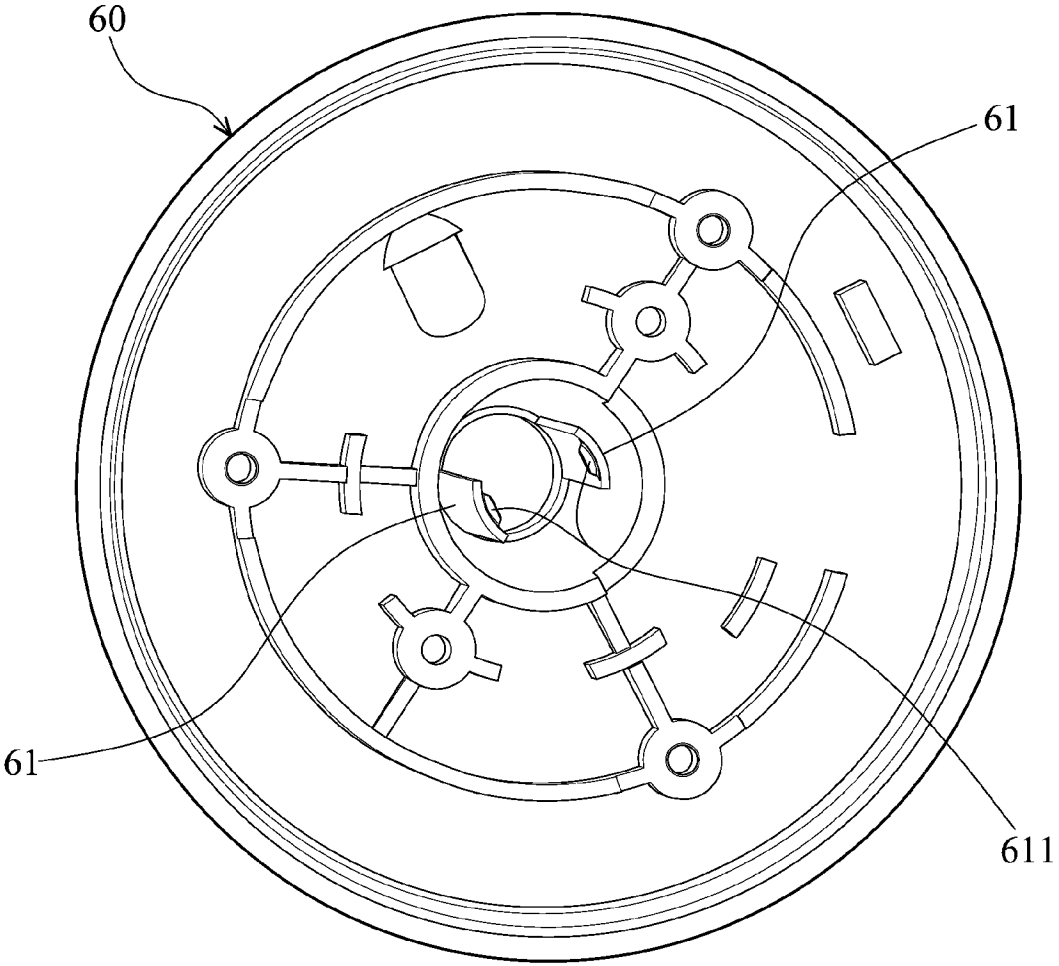
FIG. 4A is a perspective diagram of the housing in FIG. 2.
Figure 4B:
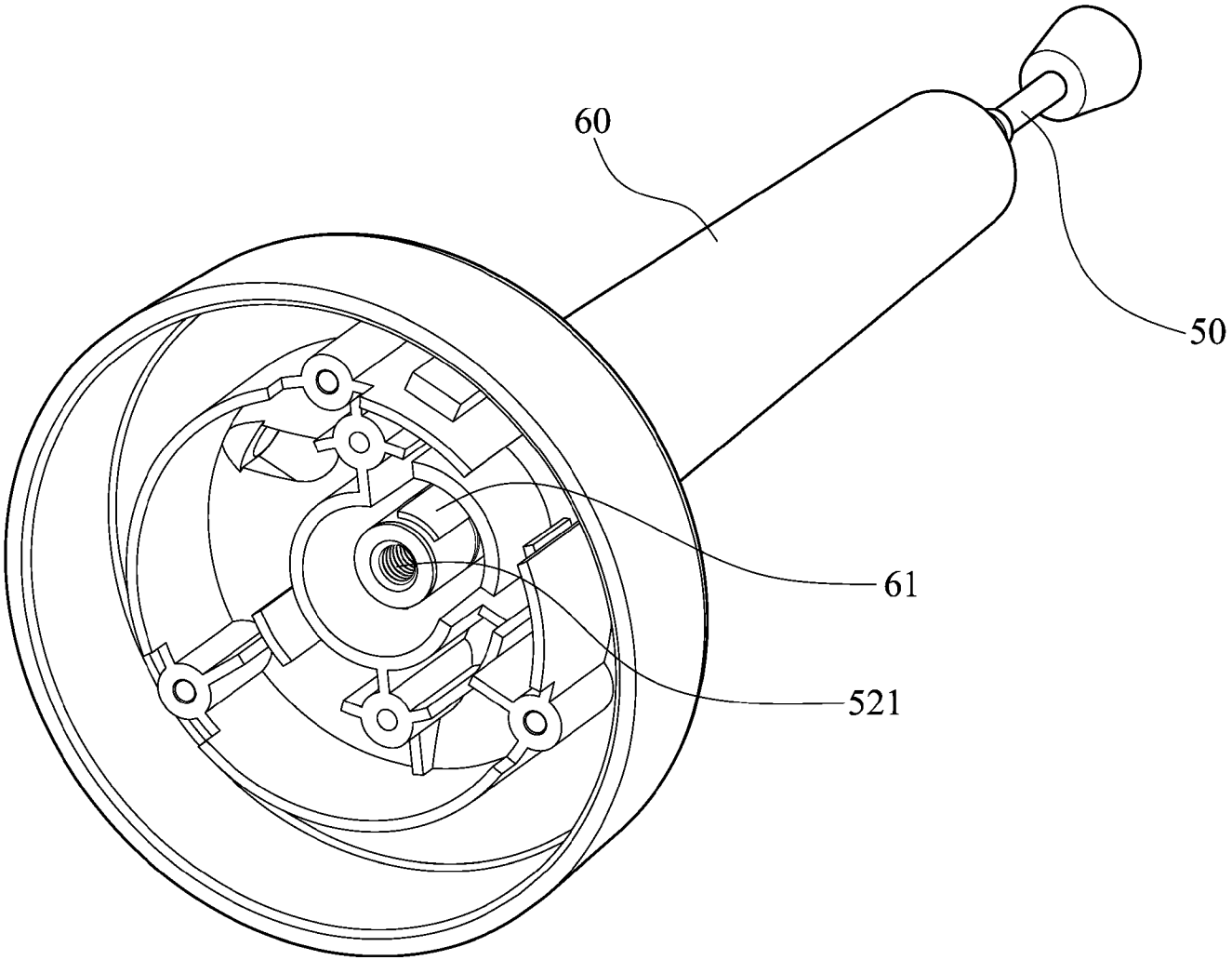
FIG. 4B is a perspective diagram of the antenna engaged with the housing.

Referring to FIGS. 4A and 4B, the housing 60 is plastic and comprises two flexible cantilevers 61, wherein each of the flexible cantilevers 61 has a nub 611 projecting from an inner surface thereof. During assembly, the antenna 50 is inserted through the housing 60 and presses the flexible cantilevers 61 outwardly. As shown in FIG. 4B, the nubs 611 of the flexible cantilevers 61 are subsequently engaged in the through holes 512 of the antenna 50, such that the antenna 50 and the housing 60 are firmly connected. It is noted that the nubs 611 are extended through the through holes 512 to the annular recess 522 of the antenna 50, thus preventing slipping or separation of the antenna 50 from the housing 60.

Figure 5:
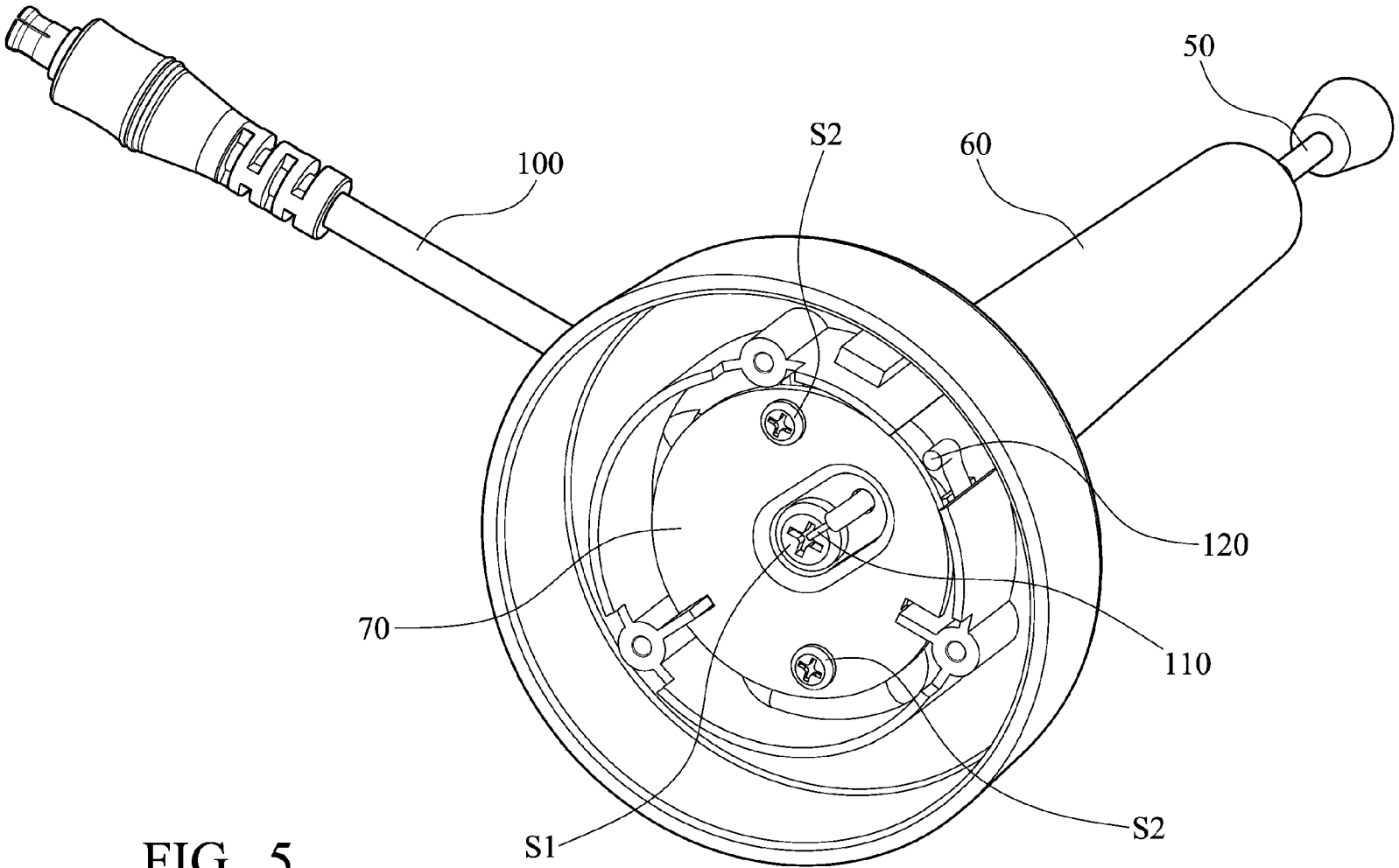
FIG. 5 is a perspective diagram of a first member fixed to the housing.

Referring to FIG. 5, after the antenna 50 is fixed to the housing 60, the first member 70 is mounted to the housing 60 by the screws S2, and the fastener S1 is fastened through the first member 70 and joined to the threaded hole 521 of the connecting member 52. As shown in FIG. 5, a signal terminal 110 of the cable 100 is extended out through the first member 70 and welded on the fastener S1, such that the signal terminal 110 is electrically connected to the antenna 50.

Figure 6:
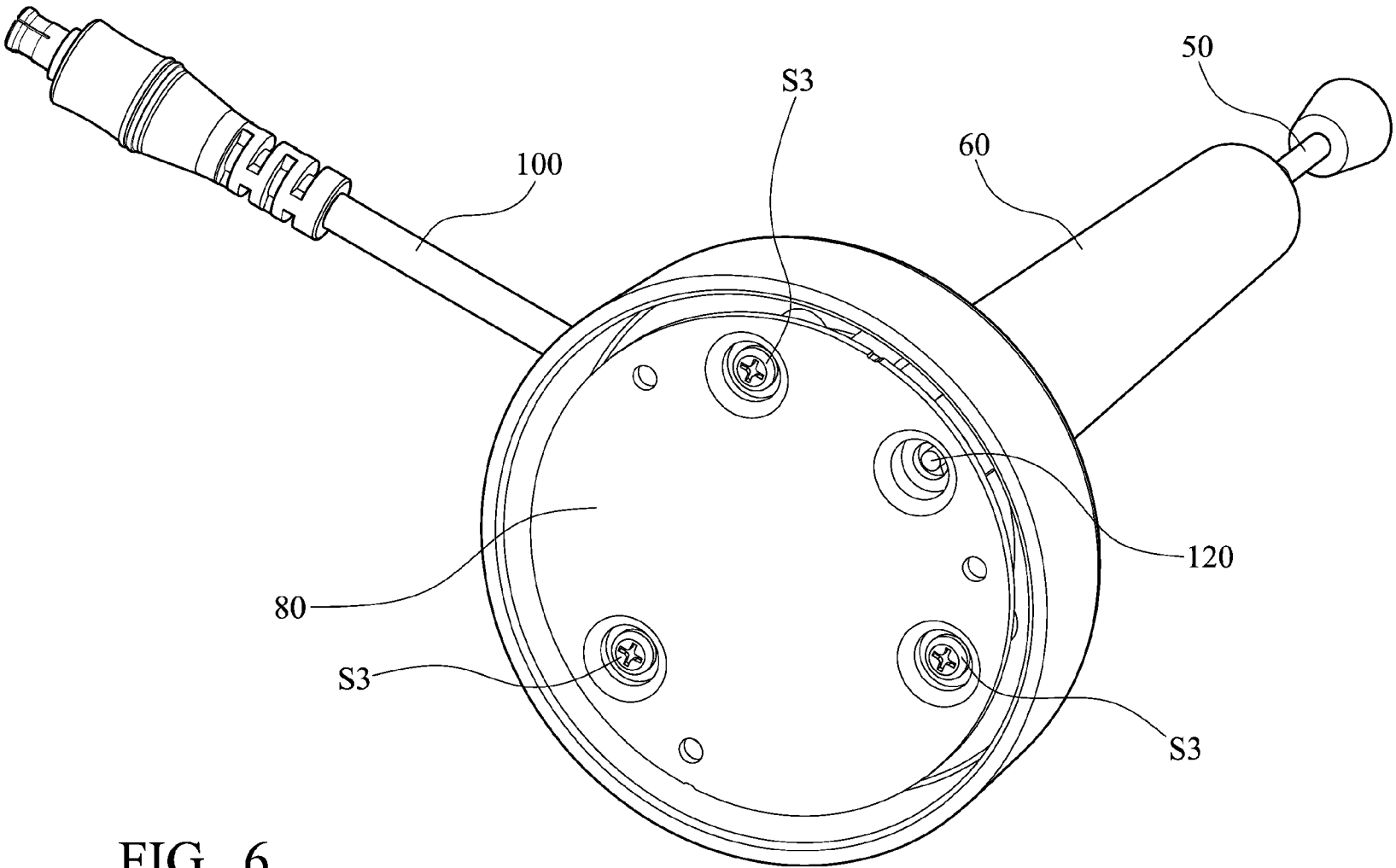
FIG. 6 is a perspective diagram of a second member fixed to the housing.

After assembly of the first member 70 and the housing 60, the second member 80 is mounted to the housing 60 by the screws S3, as shown in FIG. 6, and a ground terminal 120 of the cable 100 is extended out through the second member 80. In this embodiment, the first and second members 70 and 80 are metal plates electrically independent from each other, wherein the first member 70 is concealed by the second member 80 during assembly.

Figure 1:
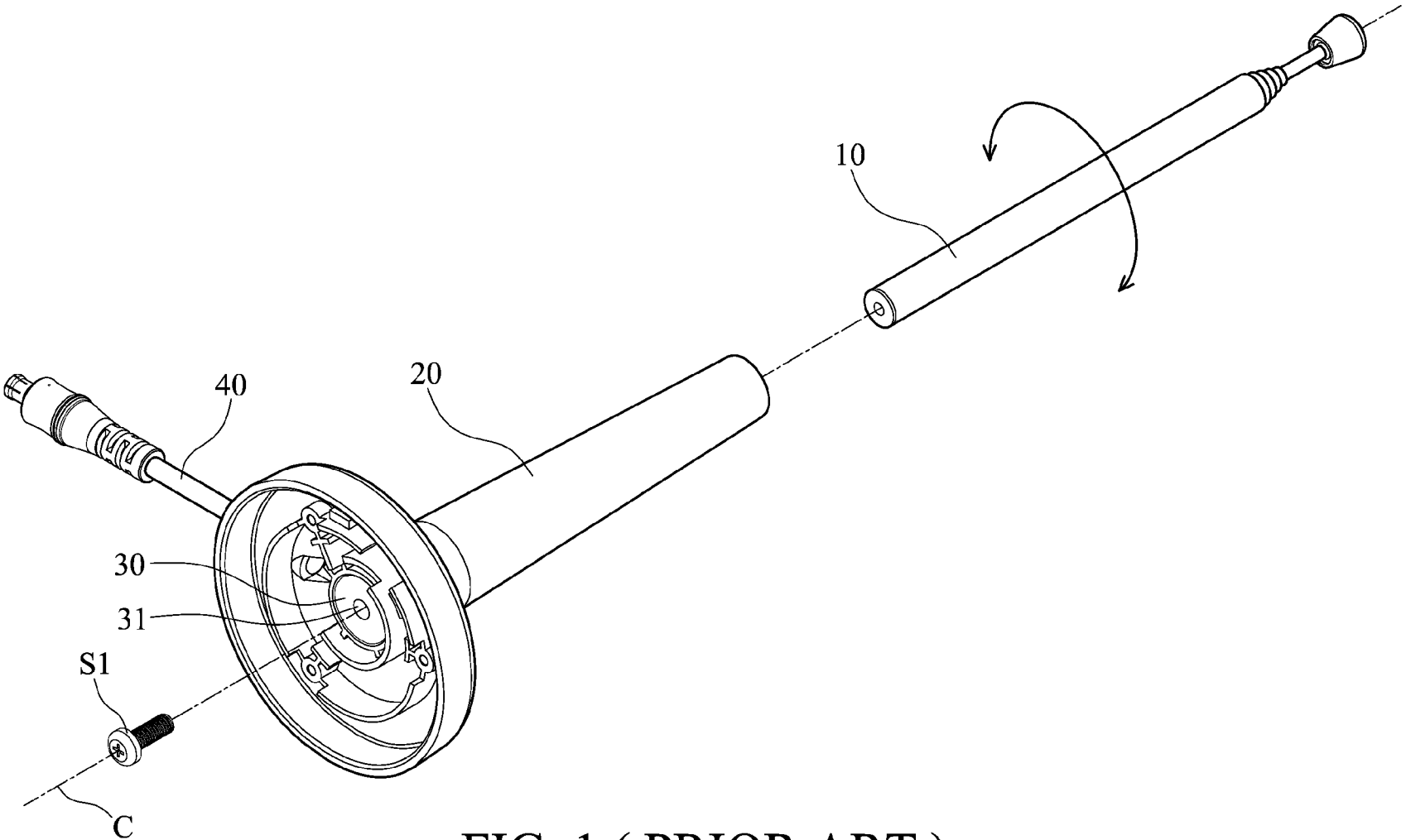
FIG. 1 ( PRIOR ART )
FIG. 1 is a perspective diagram of a conventional antenna module.

The invention provides an antenna module comprising a housing and an antenna directly fixed to the housing. An embodiment of the housing comprises at least a nub engaged in a through hole of the antenna, thereby preventing rotation or disengagement of the antenna from the housing and improving communication stability of the antenna. In another aspect, the invention uses the fastener directly fixing the first member to the housing, not requiring the conventionally used nut 30 welded on the housing (FIG. 1), thus simplifying assembly and saving production costs.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. An antenna module, comprising:

an antenna, comprising at least a through hole;

a housing with the antenna disposed therethrough, wherein the housing comprises at least a flexible cantilever having a nub engaged in the through hole of the antenna;

a first member, fixed to the housing; and a fastener, disposed through the first member and joined to the antenna, wherein the antenna further comprises a hollow main body and a connecting member fixed to an end of the main body, wherein the through hole is formed on the main body, and the fastener is joined to the connecting member.

2. The antenna module as claimed in claim 1, wherein the first member is fixed to the housing by screws.

3. The antenna module as claimed in claim 1, wherein the antenna is a telescopic antenna electrically connected to the fastener.

4. The antenna module as claimed in claim 1, wherein the housing comprises plastic.

5. The antenna module as claimed in claim 1, wherein the antenna further comprises two through holes, and the housing further comprises two flexible cantilevers corresponding to the through holes.

6. The antenna module as claimed in claim 1, wherein the connecting member forms an annular recess communicating with the through hole, and the nub is extended through the through hole to the annular recess.

7. The antenna module as claimed in claim 1, wherein the fastener is a screw, and the connecting member forms a threaded hole with the screw joined therein.

8. The antenna module as claimed in claim 1, further comprising a second member fixed to the housing and a cable disposed through the housing, wherein the cable comprises a signal terminal connected to the first member and a ground terminal connected to the second member.

9. The antenna module as claimed in claim 8, wherein the second member covers the first member and connects to the housing by screws.

10. The antenna module as claimed in claim 8, wherein the first and second members are metal, and the first member electrically connects to the fastener.

11. The antenna module as claimed in claim 8, further comprising a cover fixed to the housing and concealing the second member.

12. The antenna module as claimed in claim 8, wherein the cable is a coaxial cable.

13. The antenna module as claimed in claim 8, wherein the signal terminal is disposed through the first member and welded thereon.

14. The antenna module as claimed in claim 8, wherein the ground terminal is disposed through the second member and welded thereon.

* * * * *